US010468769B2

(12) United States Patent
Ahn et al.

(10) Patent No.: US 10,468,769 B2
(45) Date of Patent: Nov. 5, 2019

(54) MULTI-BAND ANTENNA DEVICE AND ELECTRONIC DEVICE HAVING THE SAME

(71) Applicant: Samsung Electronics Co., Ltd., Suwon-si, Gyeonggi-do (KR)

(72) Inventors: Jungho Ahn, Seoul (KR); Boram Namgoong, Suwon-si (KR); Moonseok Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/904,150

(22) Filed: Feb. 23, 2018

(65) Prior Publication Data

US 2018/0241123 A1 Aug. 23, 2018

(30) Foreign Application Priority Data

Feb. 23, 2017 (KR) ..... 10-2017-0024395

(51) Int. Cl.

| | |
|---|---|
| ***H01Q 21/00*** | (2006.01) |
| ***H01Q 5/25*** | (2015.01) |
| ***H01Q 21/06*** | (2006.01) |
| ***H01Q 19/02*** | (2006.01) |
| ***H01Q 1/22*** | (2006.01) |
| ***H01Q 1/27*** | (2006.01) |
| ***H01Q 1/38*** | (2006.01) |
| ***H01Q 9/42*** | (2006.01) |
| ***H01Q 21/28*** | (2006.01) |
| *H01Q 11/02* | (2006.01) |
| *H01Q 1/40* | (2006.01) |

(52) U.S. Cl.

CPC ..... *H01Q 5/25* (2015.01); *H01Q 1/2291* (2013.01); *H01Q 1/273* (2013.01); *H01Q 1/38* (2013.01); *H01Q 9/42* (2013.01); *H01Q 19/02* (2013.01); *H01Q 21/06* (2013.01); *H01Q 21/28* (2013.01); *H01Q 1/40* (2013.01)

(58) Field of Classification Search

CPC ..... H01Q 1/242; H01Q 1/243; H01Q 1/244; H01Q 1/40; H01Q 1/42; H01Q 25/00; H01Q 21/28

USPC ..... 343/702, 725–729, 737, 742, 751, 767, 343/770, 872, 873, 893

See application file for complete search history.

(56) References Cited

U.S. PATENT DOCUMENTS 9,484,631 B1 * 11/2016 Napoles ..... H01Q 1/243
2004/0212545 A1 10/2004 Li et al.

(Continued)

FOREIGN PATENT DOCUMENTS

KR 10-0982028 B1 9/2010
KR 10-2012-0139090 A 12/2012

(Continued)

*Primary Examiner* — Binh B Tran

(57) ABSTRACT

The present disclosure relates generally to a multi-band antenna device and an electronic device having the same. An antenna device according to embodiments may include a first antenna and a second antenna. The first antenna may include a first ground terminal, a first feed terminal, and a first radiator. The second antenna may include a second ground terminal, a second feed terminal, a second radiator, and a conductor pattern electrically connected to the second ground terminal. The conductor pattern may be formed at a position capable of causing coupling with the first radiator. Other embodiments are possible.

14 Claims, 12 Drawing Sheets

(56) References Cited

U.S. PATENT DOCUMENTS

| | | | | |
|---|---|---|---|---|
| 2005/0001769 | A1* | 1/2005 | Qi | H01Q 1/243<br>343/700 MS |
| 2012/0262343 | A1 | 10/2012 | Radojkovic | |
| 2012/0319904 | A1 | 12/2012 | Lee et al. | |
| 2013/0234911 | A1 | 9/2013 | Lee | |
| 2014/0176369 | A1 | 6/2014 | Choi et al. | |
| 2016/0365623 | A1* | 12/2016 | Kim | H01Q 1/243 |

FOREIGN PATENT DOCUMENTS

| | | | |
|---|---|---|---|
| KR | 10-2013-0102170 | A | 9/2013 |
| KR | 10-1389392 | B1 | 4/2014 |
| KR | 10-1413986 | B1 | 7/2014 |

* cited by examiner

MULTI-BAND ANTENNA DEVICE AND ELECTRONIC DEVICE HAVING THE SAME

CROSS-REFERENCE TO RELATED APPLICATION AND CLAIM OF PRIORITY

This application is related to and claims priority to Korean Patent Application No. 10-2017-0024395 filed on Feb. 23, 2017, the contents of which are incorporated herein by reference.

TECHNICAL FIELD

The present disclosure relates generally to a multi-band antenna device and an electronic device having the same. More particularly, the present disclosure relates to a technique for enhancing the performance of an antenna device by using a coupling phenomenon occurring between antennas.

BACKGROUND

Wireless communication technologies for a human-centered connectivity network are now evolving into new technologies for an internet of things (IoT) in which distributed entities, such as things, exchange and process information without human intervention. The IoT may be applied to a variety of fields including smart homes, smart buildings, smart cities, smart cars or connected cars, smart grids, health care, smart appliances, and advanced medical services through convergence and combination between existing information technology (IT) and various industrial applications.

In order to implement the IoT, one electronic device should be able to perform wireless communication with distributed entities such as automobiles, home appliances, and other devices. Therefore, recently developed electronic devices are required to support multi-band wireless communication for wireless communication with various distributed entities and also to support a wide bandwidth for high-speed communication.

With such demands, one electronic device may include a plurality of antennas, but space constraints may occur because of reductions in size and weight of the electronic device. Particularly, a size-reduced electronic device may undergo signal interference between antennas because the antennas are mounted close to each other.

SUMMARY

To address the above-discussed deficiencies, it is a primary object to provide an antenna device that supports multi-band wireless communication according to various embodiments of the present disclosure which may provide improved radiation efficiency in a specific frequency band and also provide improved broadening of band.

An antenna device that supports multi-band wireless communication according to various embodiments of the present disclosure may ensure an isolation feature between antennas mounted in a size-reduced electronic device.

According to various embodiments of the present disclosure, an antenna device may comprise a first antenna including a first ground terminal, a first feed terminal, and a first radiator; and a second antenna including a second ground terminal, a second feed terminal, a second radiator, and a conductor pattern electrically connected to the second ground terminal, wherein the conductor pattern is formed at a position capable of causing coupling with the first radiator.

According to various embodiments of the present disclosure, an electronic device may comprise a first antenna including a first ground terminal, a first feed terminal, and a first radiator; and a second antenna including a second ground terminal, a second feed terminal, a second radiator, and a conductor pattern electrically connected to the second ground terminal, wherein the conductor pattern is formed at a position capable of causing coupling with the first radiator.

According to various embodiments of the present disclosure, an electronic device may comprise a first antenna carrier configured to have a first antenna including a first ground terminal, a first feed terminal, and a first radiator; a second antenna carrier configured to have a second antenna including a second ground terminal, a second feed terminal, a second radiator, and a conductor pattern electrically connected to the second ground terminal; and a substrate configured to transmit a radio frequency (RF) signal for realizing coupling between the conductor pattern and the first radiator.

The antenna device according to various embodiments of the present disclosure not only supports data communication in multiple bands, but also increases the antenna radiation efficiency to have a higher gain and a wider bandwidth in a specific band.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
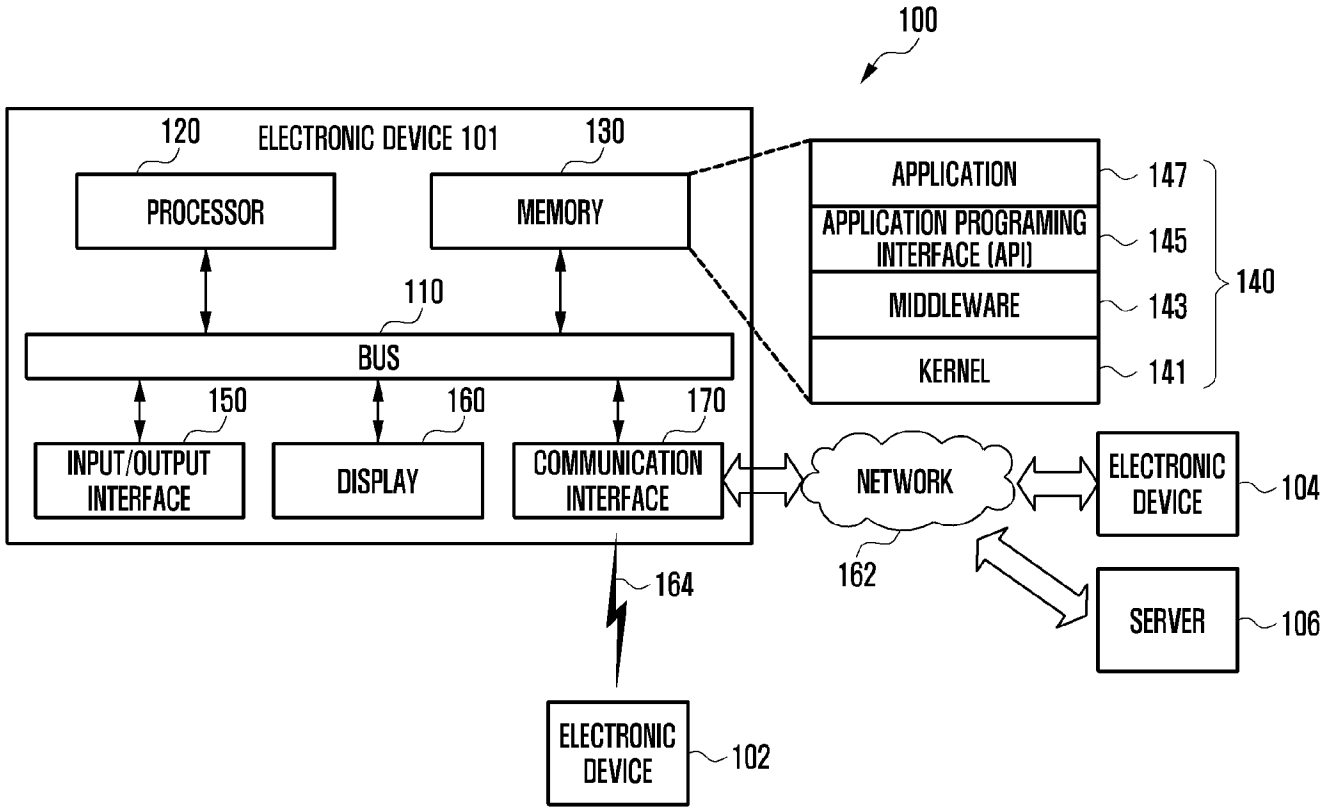
FIG. 1 illustrates a diagram of a network environment including an electronic device according to various embodiments of the present disclosure.

FIGS. 1 through 8B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, various embodiments of the present disclosure will be described with reference to the accompanying drawings. However, it should be understood that there is no intent to limit the present disclosure to the particular forms disclosed herein; rather, the present disclosure should be construed to cover various modifications, equivalents, and/or alternatives of embodiments of the present disclosure. In describing the drawings, similar reference numerals may be used to designate similar constituent elements.

As used herein, the expression "have", "may have", "include", or "may include" refers to the existence of a corresponding feature (e.g., numeral, function, operation, or constituent element such as component), and does not exclude one or more additional features.

In the present disclosure, the expression "A or B", "at least one of A or/and B", or "one or more of A or/and B" may include all possible combinations of the items listed. For example, the expression "A or B", "at least one of A and B", or "at least one of A or B" refers to all of (1) including at least one A, (2) including at least one B, or (3) including all of at least one A and at least one B.

The expression "a first", "a second", "the first", or "the second" used in various embodiments of the present disclosure may modify various components regardless of the order and/or the importance but does not limit the corresponding components. For example, a first user device and a second user device indicate different user devices although both of them are user devices. For example, a first element may be termed a second element, and similarly, a second element may be termed a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposed between them. In contrast, it may be understood that when an element (e.g., first element) is referred to as being "directly connected," or "directly coupled" to another element (second element), there is no element (e.g., third element) interposed between them.

The expression "configured to" used in the present disclosure may be exchanged with, for example, "suitable for", "having the capacity to", "designed to", "adapted to", "made to", or "capable of" according to the situation. The term "configured to" may not necessarily imply "specifically designed to" in hardware. Alternatively, in some situations, the expression "device configured to" may mean that the device, together with other devices or components, "is able to". For example, the phrase "processor adapted (or configured) to perform A, B, and C" may mean a dedicated processor (e.g. embedded processor) only for performing the corresponding operations or a generic-purpose processor (e.g., central processing unit (CPU) or application processor (AP)) that can perform the corresponding operations by executing one or more software programs stored in a memory device.

The terms used in the present disclosure are only used to describe specific embodiments, and are not intended to limit the present disclosure. As used herein, singular forms may include plural forms as well unless the context clearly indicates otherwise. Unless defined otherwise, all terms used herein, including technical and scientific terms, have the same meaning as those commonly understood by a person skilled in the art to which the present disclosure pertains. Such terms as those defined in a generally used dictionary may be interpreted to have the meanings equal to the contextual meanings in the relevant field of art, and are not to be interpreted to have ideal or excessively formal meanings unless clearly defined in the present disclosure. In some cases, even the term defined in the present disclosure should not be interpreted to exclude embodiments of the present disclosure.

In this disclosure, an electronic device may be a device that involves a communication function. For example, an electronic device may be a smart phone, a tablet PC (Personal Computer), a mobile phone, a video phone, an e-book reader, a desktop PC, a laptop PC, a netbook computer, a PDA (Personal Digital Assistant), a PMP (Portable Multimedia Player), an MP3 player, a portable medical device, a digital camera, or a wearable device (e.g., an HMD (Head-Mounted Device) such as electronic glasses, electronic clothes, an electronic bracelet, an electronic necklace, an electronic accessory, an electronic tattoo, a smart mirror, or a smart watch).

According to another embodiment, the electronic device may include at least one of various medical devices (e.g., various portable medical measuring devices (a blood glucose monitoring device, a heart rate monitoring device, a blood pressure measuring device, a body temperature measuring device, etc.), a Magnetic Resonance Angiography (MRA), a Magnetic Resonance Imaging (MRI), a Computed Tomography (CT) machine, and an ultrasonic machine), a navigation device, a Global Positioning System (GPS) receiver, an Event Data Recorder (EDR), a Flight Data Recorder (FDR), a Vehicle Infotainment Device, an electronic device for a ship (e.g., a navigation device for a ship, and a gyro-compass), avionics, security devices, an automotive head unit, a robot for home or industry, an automatic teller's machine (ATM) in banks, point of sales (POS) in a shop, or internet device of things (e.g., a light bulb, various sensors, electric or gas meter, a sprinkler device, a fire alarm, a thermostat, a streetlamp, a toaster, a sporting goods, a hot water tank, a heater, a boiler, etc.)

According to some embodiments, an electronic device may be furniture or part of a building or construction having a communication function, an electronic board, an electronic signature receiving device, a projector, or various measuring instruments (e.g., a water meter, an electric meter, a gas meter, a wave meter, etc.). An electronic device disclosed herein may be one of the above-mentioned devices or any combination thereof.

Hereinafter, an electronic device according to various embodiments will be described with reference to the accompanying drawings. As used herein, the term "user" may indicate a person who uses an electronic device or a device (e.g., an artificial intelligence electronic device) that uses an electronic device.

FIG. 1 illustrates a network environment including an electronic device according to various embodiments of the present disclosure.

Referring to FIG. 1, an electronic device 101, in a network environment 100, includes a bus 110, a processor 120, a memory 130, an input/output interface 150, a display 160, and a communication interface 170. According to some embodiments, the electronic device 101 may omit at least one of the components or further include another component.

The bus 110 may be a circuit connecting the above described components and transmitting communication (e.g., a control message) between the above described components.

The processor 120 may include one or more of central processing unit (CPU), application processor (AP) or communication processor (CP). For example, the processor 120 may control at least one component of the electronic device 101 and/or execute calculation relating to communication or data processing.

The memory 130 may include volatile and/or non-volatile memory. For example, the memory 130 may store command or data relating to at least one component of the electronic device 101. According to some embodiment, the memory may store software and/or a program 140. For example, the program 140 may include a kernel 141, middleware 143, an application programming interface (API) 145, and/or an application 147 and so on. At least one portion of the kernel 141, the middleware 143 and the API 145 may be defined as an operating system (OS).

The kernel 141 controls or manages system resources (e.g., the bus 110, the processor 120, or the memory 130) used for executing an operation or function implemented by the remaining other program, for example, the middleware 143, the API 145, or the application 147. Further, the kernel 141 provides an interface for accessing individual components of the electronic device 101 from the middleware 143, the API 145, or the application 147 to control or manage the components.

The middleware 143 performs a relay function of allowing the API 145 or the application 147 to communicate with the kernel 141 to exchange data. Further, in operation requests received from the application 147, the middleware 143 performs a control for the operation requests (e.g., scheduling or load balancing) by using a method of assigning a priority, by which system resources (e.g., the bus 110, the processor 120, the memory 130 and the like) of the electronic device 101 may be used, to the application 147.

The API 145 is an interface by which the application 147 may control a function provided by the kernel 141 or the middleware 143 and includes, for example, at least one interface or function (e.g., command) for a file control, a window control, image processing, or a character control.

The input/output interface 150 may be an interface to transmit command or data inputted by a user or another external device to another component(s) of the electronic device 101. Further, the input/output interface 150 may output the command or data received from the another component(s) of the electronic device 101 to the user or the another external device.

The display 160 may include, for example, a liquid crystal display (LCD), light emitting diode (LED), organic LED (OLED), or micro electro mechanical system (MEMS) display, or an electronic paper display. The display 160 may display, for example, various contents (text, image, video, icon, or symbol, and so on) to a user. The display 160 may include a touch screen, and receive touch, gesture, approaching, or hovering input using a part of the body of the user.

The communication interface 170 may set up communication of the electronic device 101 and external device (e.g., a first external device 102, a second external device 104, or a server 106). For example, the communication interface 170 may be connected with the network 162 through wireless communication or wire communication and communicate with the external device (e.g., a second external device 104 or server 106).

Wireless communication may use, as cellular communication protocol, at least one of LTE (long-term evolution), LTE-A (LTE Advance), CDMA (code division multiple access), WCDMA (wideband CDMA), UMTS (universal mobile telecommunications system), WiBro (Wireless Broadband), GSM (Global System for Mobile Communications), and the like, for example. A short-range communication 164 may include, for example, at least one of Wi-Fi, Bluetooth, Near Field Communication (NFC), and Global Navigation Satellite System (GNSS), and the like.

The GNSS may include at least one of, for example, a Global Positioning System (GPS), a Global navigation satellite system (Glonass), a Beidou Navigation Satellite System (hereinafter, referred to as "Beidou"), and Galileo (European global satellite-based navigation system). Hereinafter, the "GPS" may be interchangeably used with the "GNSS" in the present disclosure. Wired communication may include, for example, at least one of USB (universal serial bus), HDMI (high definition multimedia interface), RS-232 (recommended standard-232), POTS (plain old telephone service), and the like. The network 162 may include telecommunication network, for example, at least one of a computer network (e.g., LAN or WAN), internet, or a telephone network.

Each of the first external device 102 and the second external device 104 may be the same type or a different type of device as the electronic device 101. According to some embodiments, the server 106 may include one or more group of servers. According to various embodiments, at least one portion of executions executed by the electronic device 101 may be performed by one or more electronic devices (e.g., external electronic device 102, external electronic device 104, or server 106). According to some embodiments, when the electronic device 101 should perform a function or service automatically, the electronic device 101 may request performing of at least one function to the another device (e.g., external electronic device 102, external electronic device 104, or server 106). For the above, cloud computing technology, distributed computing technology, or client-server computing technology may be used, for example.

Figure 2:
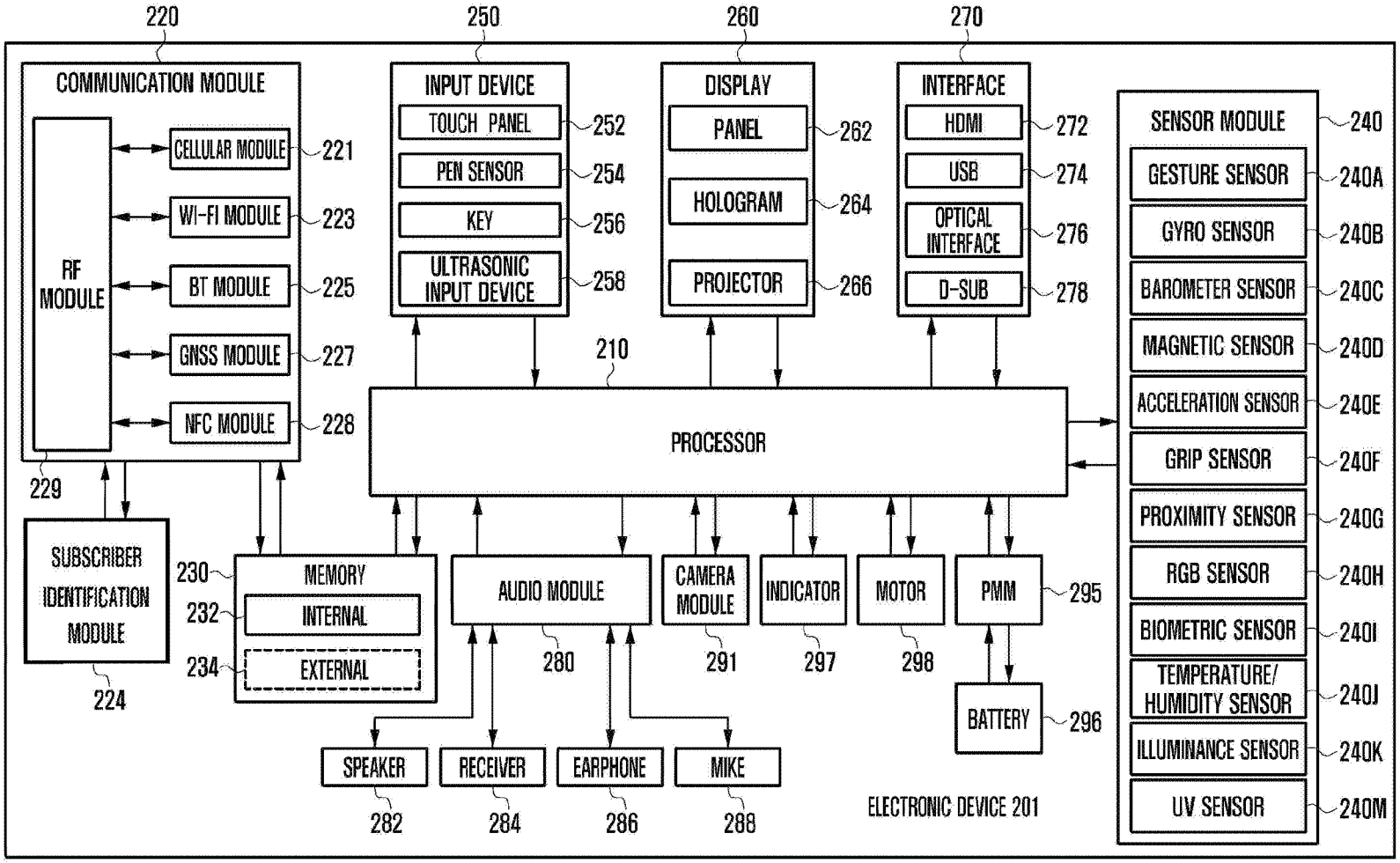
FIG. 2 illustrates a block diagram of an electronic device according to various embodiments of the present disclosure.

FIG. 2 illustrates a block diagram of an electronic device according to an embodiment of the present disclosure.

Referring to FIG. 2, an electronic device 201 may configure, for example, a whole or a part of the electronic device 101 illustrated in FIG. 1. The electronic device 201 includes one or more APs 210, a communication module 220, a subscriber identification module (SIM) card 224, a memory 230, a sensor module 240, an input device 250, a display 260, an interface 270, an audio module 280, a camera module 291, a power managing module 295, a battery 296, an indicator 297, and a motor 298.

The AP 210 operates an OS or an application program so as to control a plurality of hardware or software component elements connected to the AP 210 and execute various data processing and calculations including multimedia data. The AP 210 may be implemented by, for example, a system on chip (SoC). According to an embodiment, the processor 210 may further include a graphics processing unit (GPU) and/or image signal processor. The AP 210 may include at least one portion of components illustrated in FIG. 2 (e.g., a cellular module 221). The AP 210 may load command or data received from at least one of another component (e.g., non-volatile memory) and store various data in the non-volatile memory.

The communication module 220 may include the same or similar components with the communication interface 170 of FIG. 1. The communication module 220, for, example, may include the cellular module 221, a Wi-Fi module 223, a BT module 225, a GNSS module 227, a NFC module 228, and a radio frequency (RF) module 229.

The cellular module 221 provides a voice, a call, a video call, a short message service (SMS), or an internet service through a communication network (e.g., LTE, LTE-A, CDMA, WCDMA, UMTS, WiBro, GSM and the like). Further, the cellular module 221 may distinguish and authenticate electronic devices within a communication network by using a SIM (e.g., the SIM card 224). According to an embodiment, the cellular module 221 performs at least some of the functions which may be provided by the AP 210. For example, the cellular module 221 may perform at least some of the multimedia control functions. According to an embodiment, the cellular module 221 may include a CP.

Each of the Wi-Fi module 223, the BT module 225, the GNSS module 227, and the NFC module 228 may include, for example, a processor for processing data transmitted/received through the corresponding module. Although the cellular module 221, the Wi-Fi module 223, the BT module 225, the GNSS module 227, and the NFC module 228 are at least some (e.g., two or more) of the cellular module 221, the Wi-Fi module 223, the BT module 225, the GNSS module 227, and the NFC module 228 may be included in one integrated chip (IC) or one IC package according to one embodiment. For example, at least some (e.g., the CP corresponding to the cellular module 221 and the Wi-Fi processor corresponding to the Wi-Fi module 222) of the processors corresponding to the cellular module 221, the Wi-Fi module 223, the BT module 225, the GNSS module 227, and the NFC module 228 may be implemented by one SoC.

The RF module 229 transmits/receives data, for example, an RF signal. Although not illustrated, the RF module 229 may include, for example, a transceiver, a power amp module (PAM), a frequency filter, a low noise amplifier (LNA) and the like. Further, the RF module 229 may further include a component for transmitting/receiving electronic waves over a free air space in wireless communication, for example, a conductor, a conducting wire, and the like. Although the cellular module 221, the Wi-Fi module 223, the BT module 225, the GNSS module 227, and the NFC module 228 share one RF module 229 in FIG. 2, at least one of the cellular module 221, the Wi-Fi module 223, the BT module 225, the GNSS module 227, and the NFC module 228 may transmit/receive an RF signal through a separate RF module 229 according to one embodiment.

The SIM card 224 is a card including a SIM and may be inserted into a slot formed in a particular portion of the electronic device. The SIM card 224 includes unique identification information (e.g., integrated circuit card identifier (ICCID)) or subscriber information (e.g., international mobile subscriber identity (IMSI).

The memory 230 (e.g., memory 130) may include an internal memory 232 or an external memory 234. The internal memory 232 may include, for example, at least one of a volatile memory (e.g., a random access memory (RAM), a dynamic RAM (DRAM), a static RAM (SRAM), a synchronous dynamic RAM (SDRAM), and the like), and a non-volatile memory (e.g., a read only memory (ROM), a one time programmable ROM (OTPROM), a programmable ROM (PROM), an erasable and programmable ROM (EPROM), an electrically erasable and programmable ROM (EEPROM), a mask ROM, a flash ROM, a not and (NAND) flash memory, a not or (NOR) flash memory, and the like).

According to an embodiment, the internal memory 232 may be a solid state drive (SSD). The external memory 234 may further include a flash drive, for example, a compact flash (CF), a secure digital (SD), a micro-SD, a mini-SD, an extreme digital (xD), or a memory stick. The external memory 234 may be functionally connected to the electronic device 201 through various interfaces. According to an embodiment, the electronic device 201 may further include a storage device (or storage medium) such as a hard drive.

The sensor module 240 measures a physical quantity or detects an operation state of the electronic device 201, and converts the measured or detected information to an electronic signal. The sensor module 240 may include, for example, at least one of a gesture sensor 240A, a gyro sensor 240B, an atmospheric pressure (barometric) sensor 240C, a magnetic sensor 240D, an acceleration sensor 240E, a grip sensor 240F, a proximity sensor 240G, a color sensor 240H (e.g., red, green, and blue (RGB) sensor), a biometric sensor 240I, a temperature/humidity sensor 240J, an illumination (light) sensor 240K, and a ultraviolet (UV) sensor 240M. Additionally or alternatively, the sensor module 240 may include, for example, an E-nose sensor, an electromyography (EMG) sensor, an electroencephalogram (EEG) sensor, an electrocardiogram (ECG) sensor, an photoplethysmogram (PPG) sensor, an infrared (IR) sensor, an iris sensor, a fingerprint sensor (not illustrated), and the like. The sensor module 240 may further include a control circuit for controlling one or more sensors included in the sensor module 240.

The input device 250 includes a touch panel 252, a (digital) pen sensor 254, a key 256, and an ultrasonic input device 258. For example, the touch panel 252 may recognize a touch input in at least one type of a capacitive type, a resistive type, an infrared type, and an acoustic wave type. The touch panel 252 may further include a control circuit. In the capacitive type, the touch panel 252 may recognize proximity as well as a direct touch. The touch panel 252 may further include a tactile layer. In this embodiment, the touch panel 252 provides a tactile reaction to the user.

The (digital) pen sensor 254 may be implemented, for example, using a method identical or similar to a method of receiving a touch input of the user, or using a separate recognition sheet. The key 256 may include, for example, a physical button, an optical key, or a key pad. The ultrasonic input device 258 is a device which may detect an acoustic wave by a microphone (e.g., a microphone 288) of the electronic device 201 through an input means generating an ultrasonic signal to identify data and may perform wireless recognition. According to an embodiment, the electronic device 201 receives a user input from an external device (e.g., computer or server) connected to the electronic device 201 by using the communication module 220.

The display 260 (e.g., display 160) includes a panel 262, a hologram device 264, and a projector 266. The panel 262 may be, for example, a LCD or an active matrix OLED (AM-OLED). The panel 262 may be implemented to be, for example, flexible, transparent, or wearable. The panel 262 may be configured by the touch panel 252 and one module. The hologram device 264 shows a stereoscopic image in the air by using interference of light. The projector 266 projects light on a screen to display an image. For example, the screen may be located inside or outside the electronic device 201. According to an embodiment, the display 260 may further include a control circuit for controlling the panel 262, the hologram device 264, and the projector 266.

The interface 270 includes, for example, a HDMI 272, a USB 274, an optical interface 276, and a D-subminiature (D-sub) 278. The interface 270 may be included in, for example, the communication interface 170 illustrated in FIG. 1. Additionally or alternatively, the interface 270 may include, for example, a mobile high-definition link (MHL) interface, an SD card/multi-media card (MMC), or an infrared data association (IrDA) standard interface.

The audio module 280 bi-directionally converts a sound and an electronic signal. At least some components of the audio module 280 may be included in, for example, the input/output interface 150 illustrated in FIG. 1. The audio module 280 processes sound information input or output through, for example, a speaker 282, a receiver 284, an earphone 286, the microphone 288 and the like.

The camera module 291 is a device which may photograph a still image and a video. According to an embodiment, the camera module 291 may include one or more image sensors (e.g., a front sensor or a back sensor), an image signal processor (ISP) (not shown) or a flash (e.g., an LED or xenon lamp).

The power managing module 295 manages power of the electronic device 201. Although not illustrated, the power managing module 295 may include, for example, a power management integrated circuit (PMIC), a charger IC, or a battery 296 or fuel gauge.

The PMIC may be mounted to, for example, an integrated circuit or a SoC semiconductor. A charging method may be divided into wired and wireless methods. The charger IC charges a battery 296 and prevents over voltage or over current from flowing from a charger. According to an embodiment, the charger IC includes a charger IC for at least one of the wired charging method and the wireless charging method. The wireless charging method may include, for example, a magnetic resonance method, a magnetic induction method and an electromagnetic wave method, and additional circuits for wireless charging, for example, circuits such as a coil loop, a resonant circuit, a rectifier and the like may be added.

The battery fuel gauge measures, for example, a remaining quantity of the battery 296, or a voltage, a current, or a temperature during charging. The battery 296 may store or generate electricity and supply power to the electronic device 201 by using the stored or generated electricity. The battery 296 may include a rechargeable battery or a solar battery.

The indicator 297 shows particular statuses of the electronic device 201 or a part (e.g., AP 210) of the electronic device 201, for example, a booting status, a message status, a charging status and the like. The motor 298 converts an electrical signal to a mechanical vibration. Although not illustrated, the electronic device 201 may include a processing unit (e.g., GPU) for supporting a module TV. The processing unit for supporting the mobile TV may process, for example, media data according to a standard of digital multimedia broadcasting (DMB), digital video broadcasting (DVB), media flow and the like.

Each of the components of the electronic device 201 according to various embodiments of the present disclosure may be implemented by one or more components and the name of the corresponding component may vary depending on a type of the electronic device 201. The electronic device 201 according to various embodiments of the present disclosure may include at least one of the above described components, a few of the components may be omitted, or additional components may be further included. Also, some of the components of the electronic device 201 according to various embodiments of the present disclosure may be combined to form a single entity, and thus may equivalently execute functions of the corresponding components before being combined.

Figure 3:
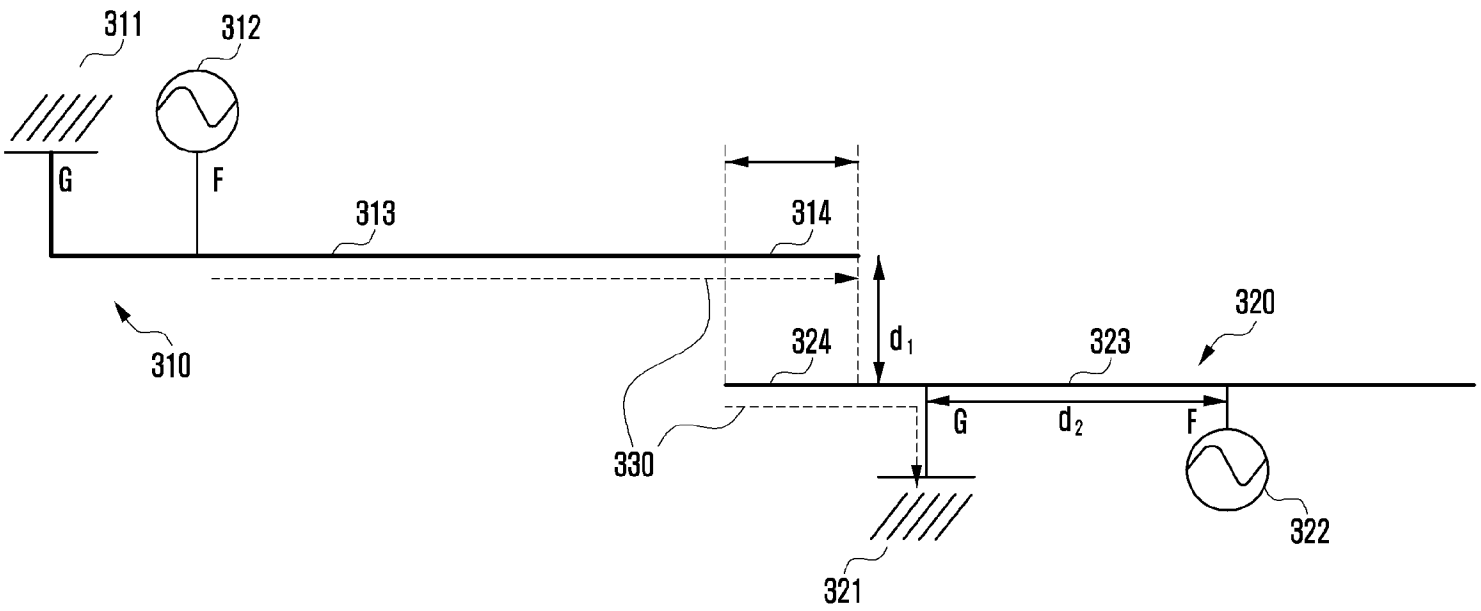
FIG. 3 illustrates a schematic diagram of an antenna device according to various embodiments of the present disclosure.

FIG. 3 illustrates a schematic diagram of an antenna device according to various embodiments of the present disclosure.

As shown in FIG. 3, the antenna device may include a first antenna 310 and a second antenna 320. Each antenna may include a ground terminal, a feed terminal, and a radiator. For example, the first antenna 310 may include a first ground terminal 311, a first feed terminal 312, and a first radiator 313, whereas the second antenna 320 may include a second ground terminal 321, a second feed terminal 322, and a second radiator 323.

According to various embodiments, the first antenna 310 may be an antenna for performing high-capacity data communication, and the second antenna 320 may be an antenna for performing low-capacity data communication. For example, in an antenna device that supports data communication of various multiple bands (e.g., LTE, GPS/Bluetooth/Wi-Fi, etc.), the first antenna 310 may be an LTE antenna for performing high-capacity data communication. The first antenna 310 included in a microelectronic device may require low power consumption. Such an electronic device may support low power wide area (LPWA) communication, and the first antenna 310 may include, for example, an LTE-CAT antenna according to the standard of narrowband Internet of things (NB-IoT).

The second antenna 320 may be a GPS/Bluetooth/Wi-Fi antenna that performs low-capacity data communication. In order to reduce power consumption of an electronic device, for example electronic device 201, the second antenna 320 may include a Wi-Fi HaLow, Bluetooth low energy (BLE) and Ublox6 GPS antenna that has low power consumption. In this antenna device, the first antenna 310 that performs high-capacity data communication may have a higher gain and a wider bandwidth in the resonance frequency band in order to improve the transmission speed and the reliability of data communication. In particular, if the first antenna 310 supports multi-band data communication (e.g., low band and middle band), the bandwidth in the resonance frequency may be narrower than that of an antenna that supports single-band data communication (e.g., middle band). It may be therefore necessary to improve the antenna performance so as to have a wide bandwidth.

On the other hand, the second antenna 320 that performs low-capacity data communication may have no problem in reliability of communication even if the bandwidth is somewhat narrow. For example, when used for transmitting and receiving a small amount of data such as position data, the second antenna 320 may, even having a narrow bandwidth, satisfy required communication reliability and transmission speed.

Using a coupling phenomenon that occurs between antennas, the performance of the first antenna 310 may be increased. For example, when a traveling wave of the first antenna 310 delivers a feed signal to the second antenna 320 spaced at a certain distance through a coupling phenomenon, the first and second antennas 310 and 320 may realize wideband impedance matching.

According to various embodiments, the first antenna 310 may be formed of an inverted F antenna (IFA) that includes the first ground terminal 311, the first feed terminal 312, and the first radiator 313. In some embodiments, the first antenna 310 may be formed of a planar inverted F antenna (PIFA).

Meanwhile, the second antenna 320 capable of realizing the wideband impedance matching with the first antenna 310 may be formed of a modified IFA (or PIFA) structure. The modified IFA (or PIFA) structure may refer to a structure that further includes a conductor pattern for inducing coupling with another antenna in a typical IFA (or PIFA) structure that includes, for example, a feed terminal, a ground terminal, and a radiator. For example, the second antenna 320 that includes the second ground terminal 321, the second feed terminal 322, and the second radiator 323 may further include a conductor pattern 324 for producing a coupling effect with the first antenna 310.

According to various embodiments, at least a portion 314 of the first radiator 313 of the first antenna 310 may face at least a portion of the conductor pattern 324 of the second antenna 320, being spaced at a first distance (d1). For example, the first radiator 313 that receives a feed signal from the first feed terminal 312 may generate a traveling wave 330, and the traveling wave 330 may be delivered to the conductor pattern 324, spaced at the first distance (d1), and used as a coupling feed signal. The conductor pattern 324 may realize resonance coupling by receiving the coupling feed signal, and thereby realize coupling and/or broadband impedance matching. For efficient coupling between the conductor pattern 324 and the first radiator 313, the portion 314 of the first radiator 313 may face horizontally or vertically at least a portion of the conductor pattern 324. However, even when the portion 314 of the first radiator 313 is disposed at a certain angle with at least a portion of the conductor pattern 324, resonance coupling may be realized.

According to various embodiments, the first distance (d1) may be equal to or greater than 10 mm. For example, if the first and second antennas 310 and 320 are close to each other less than a distance of 10 mm, signal interference may occur between the first and second antennas 310 and 320. This may deteriorate the performance of each antenna because of signal distortion and/or offset between the first and second antennas 310 and 320. Therefore, in some embodiments the first distance (d1) is 10 mm or more.

According to various embodiments, the portion 314 of the first radiator 313 and a corresponding portion of the conductor pattern 324, facing each other, may be appropriately changed according to a used frequency band and the first distance (d1). For example, if the first radiator 313 and the conductor pattern 324 face too much, the performance of the first and second antennas may be deteriorated. On the contrary, if the first radiator 313 and the conductor pattern 324 face too little, a coupling energy may not be properly transmitted. Therefore, the portion 314 of the first radiator 313 and a corresponding portion of the conductor pattern 324 may be suitably determined in consideration of the used frequency band and the first distance (d1).

According to various embodiments, the second ground terminal 321 may be disposed closer to the conductor pattern 324 than the second feed terminal 322. For example, when the second feed terminal 322 is closer to the conductor pattern 324 than the second ground terminal 321, the performance of the second antenna 320 may be lowered. This may make the wideband impedance matching impossible between the first and second antennas 310 and 320. Therefore, in some embodiments the second ground terminal 321 is arranged closer to the conductor pattern 324 than the second feed terminal 322.

The second ground terminal 321 may determine an electrical length of the conductor pattern 324 by being connected to the conductor pattern 324. For example, the conductor pattern 324 may be configured to have a length corresponding to a frequency band in which broadband impedance matching is to be induced. For example, the length of the conductor pattern 324 may be determined, based on the wavelength of a resonant frequency band in which a coupling energy is to be generated.

In some embodiments, a dielectric material may be disposed between the first radiator 313 and the conductor pattern 324. This dielectric material may change the characteristics of the traveling wave generated in the first antenna 310 and delivered to the second antenna 320 and also induce a delivery direction of the traveling wave, thus producing the wideband impedance matching in a desired band.

In some embodiments, the first radiator 313 and the conductor pattern 324 may be connected to each other through a capacitive element (e.g., a capacitor). The capacitive element may create a coupling effect by directly connecting the antenna. For example, if a distance between the first radiator 313 and the conductor pattern 324 is too far to generate a coupling energy, the capacitive element may be connected between the first radiator 313 and the conductor pattern 324 to directly deliver a coupling feed signal.

According to various embodiments, the second feed terminal 322 may be disposed at a second distance (d2) or more away from the second ground terminal 321. For example, in order to prevent a coupling feed signal transmitted from the first antenna 310 from affecting the second radiator 323, the second feed terminal 322 may be spaced apart from the second ground terminal 321. On the other hand, in order to improve the matching of the second antenna 320, the second feed terminal 322 may transmit the feed signal in the middle of the second radiator 323. According to one embodiment, the second feed terminal 322 may be disposed at a distance of 4 mm or more away from the second ground terminal 321 and transmit the feed signal to the second radiator 323.

According to various embodiments, the first feed terminal 312 and the second feed terminal 322 may be disposed to have the maximum separation distance from each other if possible in the antenna device. Increasing the separation distance between the first and second feed terminals 312 and 322 may minimize the signal interference between the first and second antennas 310 and 320 and also reduce the signal distortion and/or offset.

Figure 4:
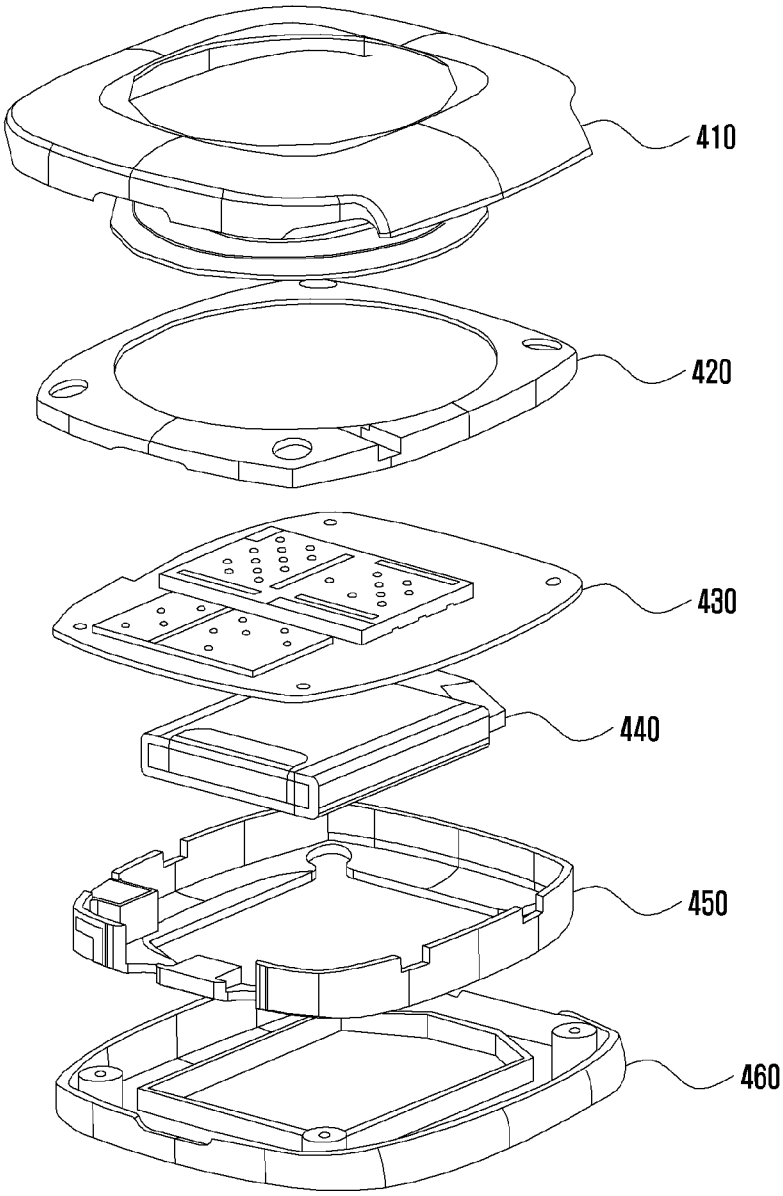
FIG. 4 illustrates a diagram of an electronic device having an antenna device according to various embodiments of the present disclosure.

FIG. 4 illustrates a diagram of an electronic device having an antenna device according to various embodiments of the present disclosure.

The electronic device may include a first housing 410, a second antenna carrier 420, a substrate 430 such as a printed circuit board (PCB) or a flexible PCB, a battery 440, a first antenna carrier 450, and a second housing 460. In some embodiments, the electronic device may omit at least one of the above elements or further include any other element.

The first and second housings 410 and 460 may contain the first antenna carrier 420, the substrate 430, the battery 440, and the second antenna carrier 420 to protect them from external shocks. According to one embodiment, the first and second housings 410 and 460 may have a metal frame structure. In this structure, coupling may occur between an antenna and the first or second housing 410 and 460. According to another embodiment, the first and second housings 410 and 460 may have a plastic injected material formed in the metal frame structure and radiate radio waves through the plastic injected material.

The first and second antenna carriers 450 and 420 may act as a body in which a metal pattern for the first and second antennas is formed, and may be mainly made of a dielectric material. The first and second antenna carriers 450 and 420 may be physically joined to the substrate 430 such that the first and second antennas are electrically coupled to the substrate 430.

The substrate 430 may be electrically coupled to the first and second antennas. For example, the substrate 430 may transmit a radio frequency (RF) signal through a feed terminal formed in each of the first and second antennas, and also determine a resonance frequency band through a ground terminal formed in each of the first and second antennas.

The battery 440 may supply power to the electronic device. The battery 440 may include a rechargeable battery and/or a solar cell.

Figure 5A:
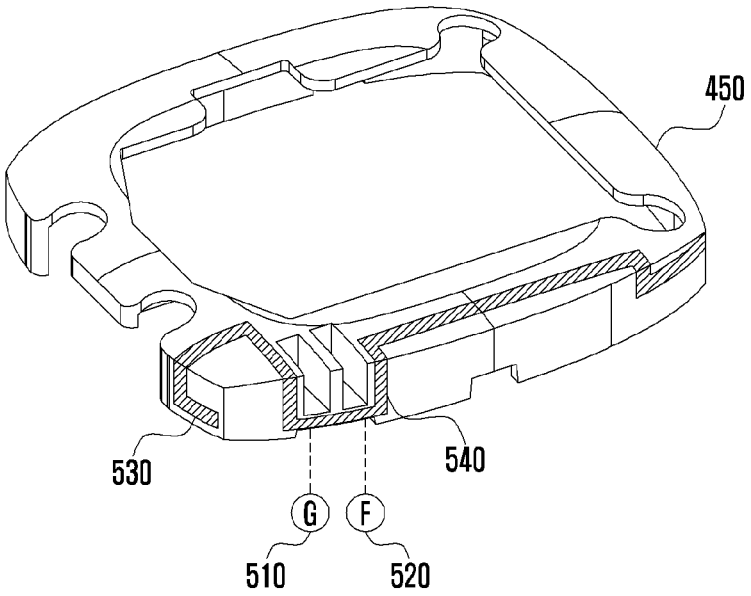
FIGS. 5A and 5B illustrates diagrams of a first antenna carrier according to various embodiments of the present disclosure.
Figure 5B:
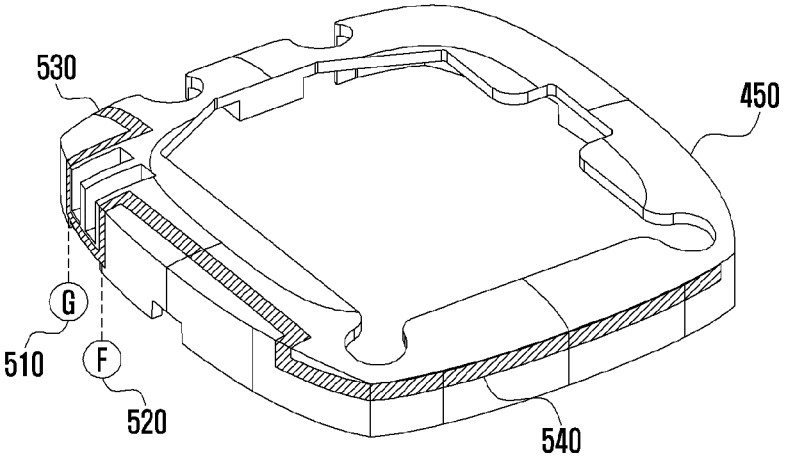

FIGS. 5A and 5B illustrates diagrams of a first antenna carrier according to various embodiments of the present disclosure.

According to various embodiments, the first antenna carrier 450 may include at least the first antenna (e.g., first antenna 310 illustrated in FIG. 1). The first antenna may include, for example, a first ground terminal 510, a first feed terminal 520, and at least two radiators 530 and 540 to support high-capacity data communication in low and middle bands.

The length and/or shape of the radiators 530 and 540 may be determined based on a supportable resonance frequency. For example, the length of each radiator 530 and 540 may be determined according to the wavelength of the resonance frequency. As shown in FIGS. 5A and 5B, the radiator 530 that is extended in short length from the first feed terminal 520 may resonate in the middle band, and the radiator 540 that is extended in long length from the first feed terminal 520 may resonate in the low band.

The first antenna carrier 450 may be physically joined to the substrate 430 and enable the first antenna 310 to be electrically coupled to the substrate 430 through the first ground terminal 510 and the first feed terminal 520 disposed therein.

Figure 6A:
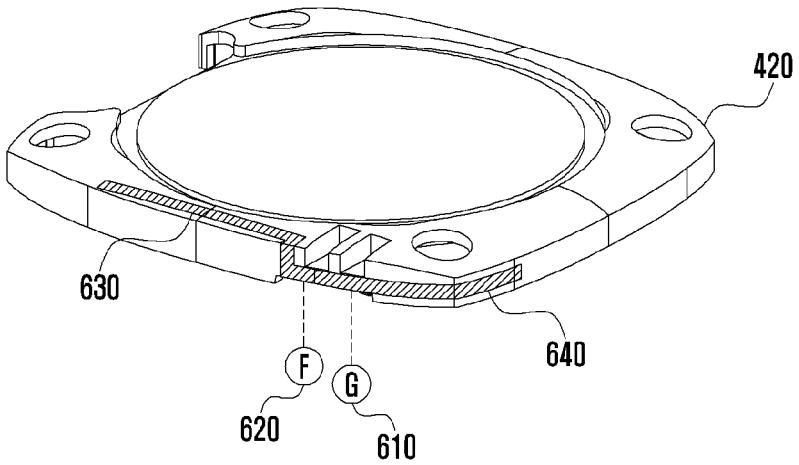
FIGS. 6A and 6B illustrate diagrams of a second antenna carrier according to various embodiments of the present disclosure.
Figure 6B:
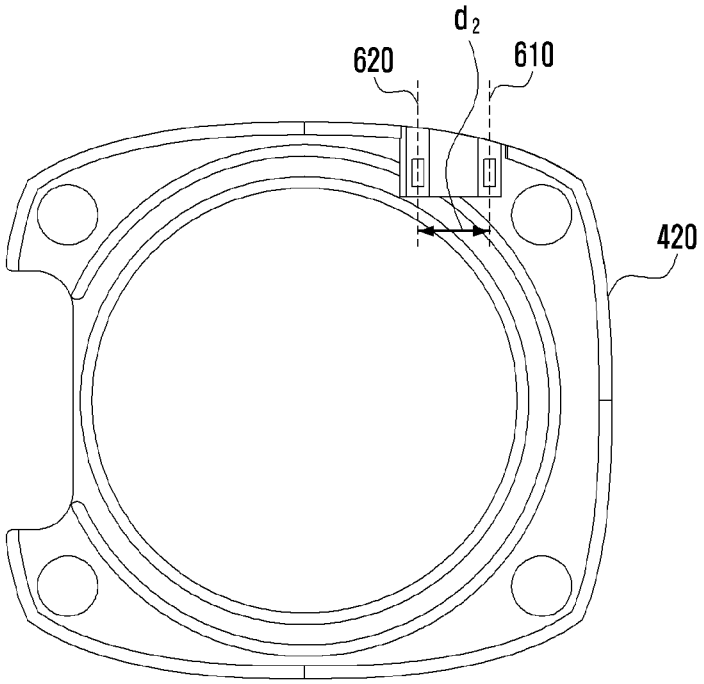

FIGS. 6A and 6B illustrate diagrams of a second antenna carrier according to various embodiments of the present disclosure.

According to various embodiments, the second antenna carrier 420 may include at least the second antenna 320. The second antenna 320 may include, for example, a second ground terminal 610, a second feed terminal 620, a second radiator 630, and a conductor pattern 640.

The length and/or shape of the second radiator 630 may be determined based on a supportable resonance frequency. For example, if the second antenna 320 is configured to support GPS wireless communication, the length and shape of the second radiator 630 may be determined to have a length corresponding to the wavelength of a GPS frequency band (e.g., 1550 to 1650 MHz).

The length and/or shape of the conductor pattern 640 may be determined, based on a frequency band for generation of a coupling energy and a relationship with the first antenna. For example, the conductor pattern 640 may be connected to the second ground terminal 610 to have a length corresponding to a frequency band for realizing wideband impedance matching. In addition, the conductor pattern 640 may have a suitable length and shape for minimizing signal interference between antennas while maximizing the coupling in consideration of a distance from the first antenna 310 and a shape of the first antenna 310.

The second antenna carrier 420 may be physically joined to the substrate 430 and enable the second antenna 320 to be electrically coupled to the substrate 430 through the second ground terminal 610 and the second feed terminal 620 disposed therein.

As shown in FIG. 6B, the second feed terminal 620 may be disposed at a second distance (d2) or more away from the second ground terminal 610. For example, the second feed terminal 620 may be disposed at a distance of 4 to 7 mm from the second ground terminal 610.

Figure 7A:
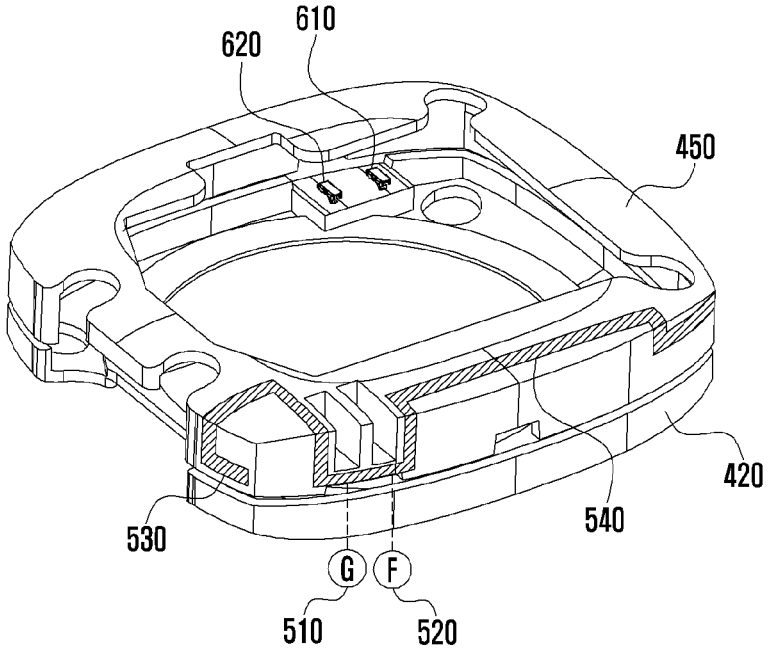
FIGS. 7A and 7B illustrate diagrams of a combination of first and second antenna carriers according to various embodiments of the present disclosure.
Figure 7B:
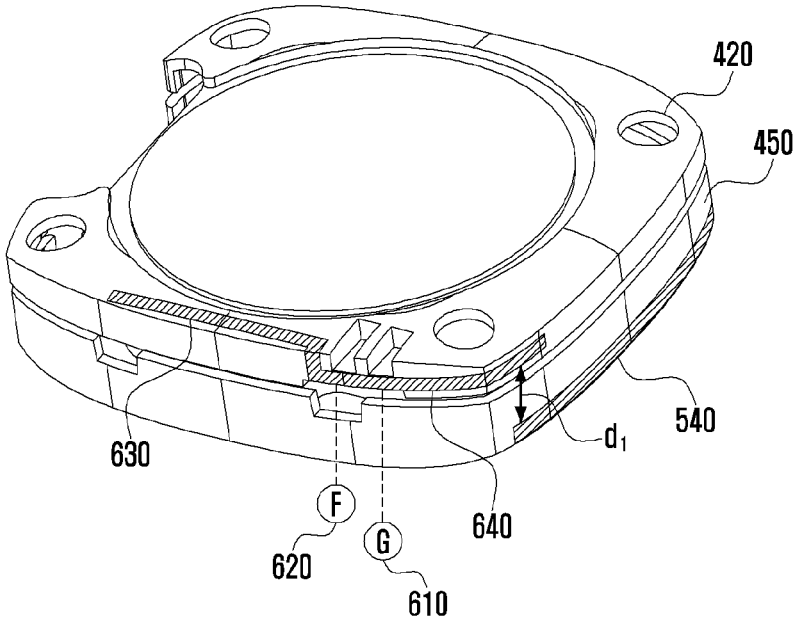

FIGS. 7A and 7B illustrate diagrams of a combination of first and second antenna carriers according to various embodiments of the present disclosure.

According to various embodiments, the first feed terminal 520 and the second feed terminal 620 may be disposed to have the maximum separation distance from each other. For example, as shown in FIG. 7A, when the first feed terminal 520 is disposed near one corner of the electronic device, the second feed terminal 620 may be disposed near the opposite corner.

According to various embodiments, the radiator 540 configured to resonate in a low band may be extended to a space adjacent to the second antenna. As shown in FIG. 7B, the radiator 540 and the conductor pattern 640, which are configured to resonate in a low band through a combination of the first and second antenna carriers 450 and 420, may be spaced at a first distance (d1). For example, the first distance (d1) may be 10 mm or more. However, in case of a microelectronic device, the first distance (d1) may range from 10 to 15 mm because of space constraints. Particularly, when the first distance (d1) is reduced to 10 mm or less, signal distortion and/or offset may occur between the first and second antennas.

Figure 8A:
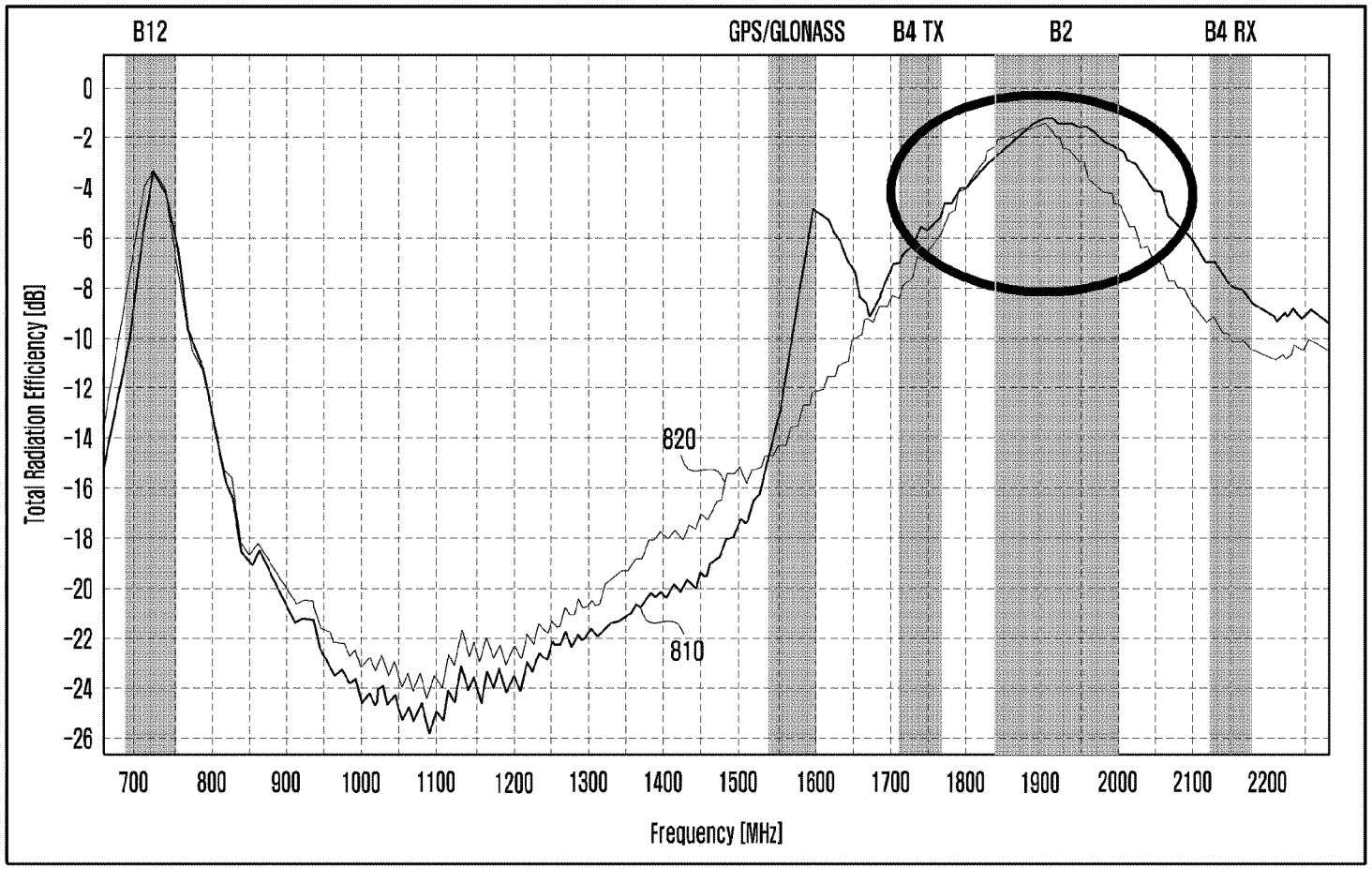
FIGS. 8A and 8B illustrate diagrams of frequency characteristics of an antenna device according to various embodiments of the present disclosure.
Figure 8B:
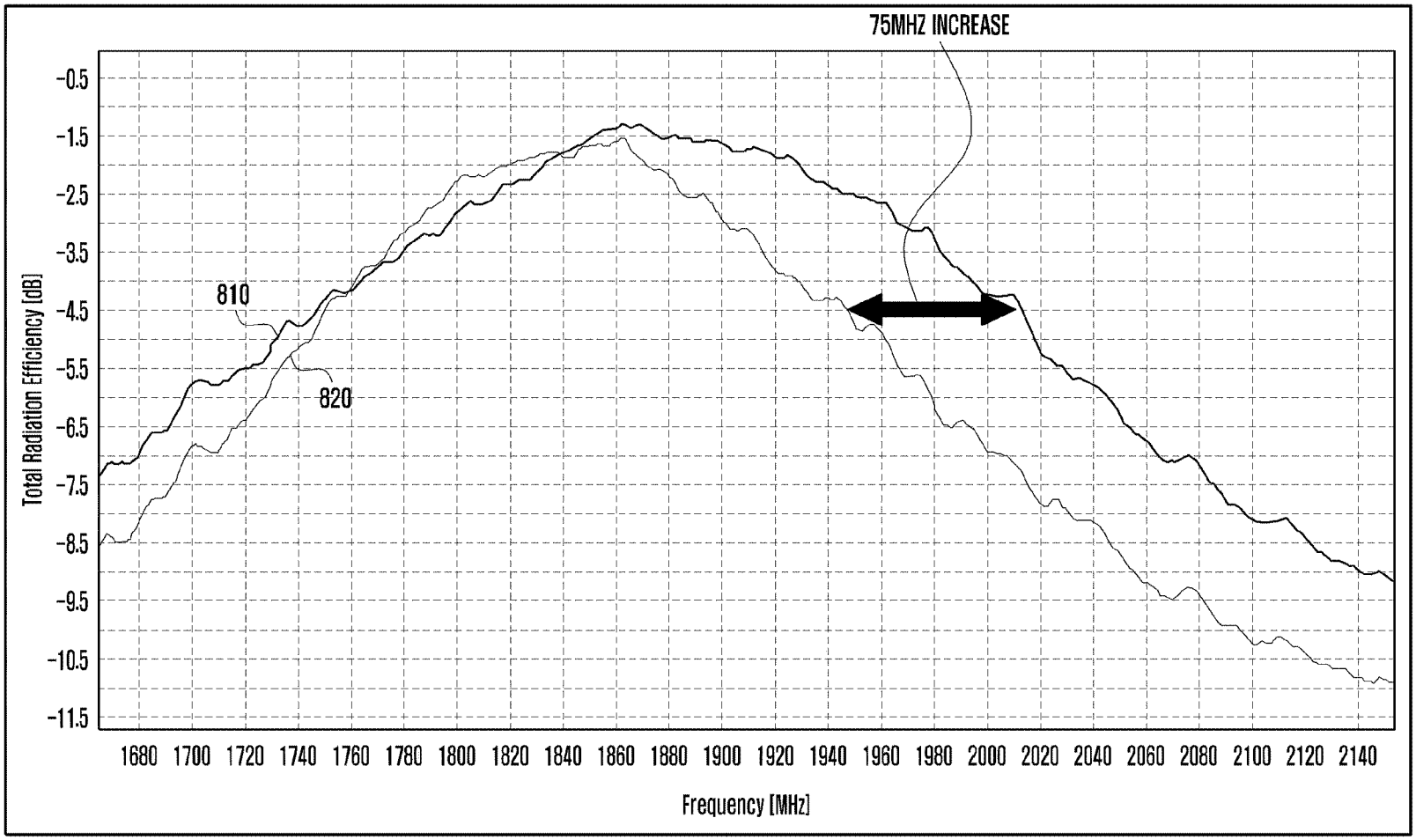

FIGS. 8A and 8B illustrate diagrams of frequency characteristics of an antenna device according to various embodiments of the present disclosure.

FIGS. 8A to 8B show a frequency characteristic 810 of the first antenna 310 used alone and a frequency characteristic 820 of the antenna device according to various embodiments of the present disclosure. It is assumed that the first antenna is configured to support data communication of both a low band (about 650 to 750 MHz) and a middle band (about 1700 to 2200 MHz).

As shown in FIG. 8A, in a low band (about 650 to 750 MHz), there is no significant difference between the frequency characteristic 810 of the first antenna 310 used alone and the frequency characteristic 820 of the antenna device according to various embodiments of the present disclosure.

In addition, it is seen that because of supporting GPS communication (about 1550 to 1600 MHz) through the second antenna 320, the antenna device according to various embodiments of the present disclosure has a high gain in the GPS frequency band.

FIG. 8B shows in detail the frequency characteristics in a middle band (about 1700 to 2200 MHz) in which the wideband impedance matching is realized.

As shown in FIG. 8B, when the first antenna 310 is used alone, the cutoff frequency is formed at about 1940 MHz. Therefore, in order to support wireless communication in the LTE B2 band (about 1900 MHz), a narrower bandwidth of about 40 MHz may be used. That is, when the first antenna 310 alone is used, high-capacity data communication in the LTE B2 band is difficult.

On the other hand, in case of the antenna device according to various embodiments, the cutoff frequency is formed at about 2015 MHz. Therefore, in order to support wireless communication in the LTE B2 band, a bandwidth of about 75 MHz may be further used in comparison with a case where the first antenna 310 is used alone. This broadening of band may enable high-capacity data communication in the LTE B2 band.

That is, the antenna device according to various embodiments of the present disclosure not only supports low-band wireless data communication in a size-reduced electronic device, but also increases the radiation efficiency of an antenna to have a higher gain and a wider bandwidth in a middle band in which wideband impedance matching is realized.

While the present disclosure has been particularly shown and described with reference to exemplary embodiments thereof, it is clearly understood that the same is by way of illustration and example only and is not to be taken in conjunction with the present disclosure. It will be understood by those skilled in the art that various changes in form and details may be made therein without departing from the subject matter and scope of the present disclosure.

The embodiments of the present disclosure are merely provided to assist in a comprehensive understanding of the disclosure and not suggestive of limitation. Therefore, it should be understood that many variations and modifications of the basic inventive concept herein described will still fall within the spirit and scope of the embodiments of the disclosure as defined in the appended claims.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An electronic device comprising:

a housing;

a first antenna carrier disposed in the housing, and configured to have a first antenna including a first ground terminal, a first feed terminal, and a first radiator;

a second antenna carrier disposed in the housing, and configured to have a second antenna including a second ground terminal, a second feed terminal, a second radiator, and a conductor pattern electrically connected to the second ground terminal; and a substrate disposed in the housing, and configured to transmit a radio frequency (RF) signal for realizing coupling between the conductor pattern and the first radiator, wherein the conductor pattern is formed at a position capable of causing coupling with the first radiator, and wherein the housing is configured to contain the first antenna carrier, the second antenna carrier, and the substrate so as to protect the first antenna carrier, the second antenna carrier, and the substrate from external shocks.

2. The electronic device of claim 1, wherein at least a portion of the first radiator faces at least a portion of the conductor pattern, being spaced at a first distance.

3. The electronic device of claim 2, wherein the first distance is equal to or greater than 10 mm.

4. The electronic device of claim 1, wherein the conductor pattern has a length corresponding to a frequency band for inducing broadband impedance matching.

5. The electronic device of claim 1, wherein the second ground terminal is disposed closer to the conductor pattern than the second feed terminal.

6. The electronic device of claim 5, wherein the second feed terminal may be disposed at a distance of 4 mm or more away from the second ground terminal.

7. The electronic device of claim 1, wherein the first antenna is an antenna configured to perform high-capacity data communication, and the second antenna is an antenna configured to perform low-capacity data communication.

8. The electronic device of claim 7, wherein the first antenna is configured to support a long term evolution (LTE) frequency band, and the second antenna is configured to support at least one of global positioning system (GPS), Bluetooth, and wireless fidelity (Wi-Fi) frequency bands.

9. The electronic device of claim 1, wherein a dielectric material is disposed between the first radiator and the conductor pattern.

10. The electronic device of claim 1, wherein the first radiator is connected to the conductor pattern through a capacitive element.

11. An electronic device comprising:

first and second housings;

a first antenna carrier configured to have a first antenna including a first ground terminal, a first feed terminal, and a first radiator;

a second antenna carrier configured to have a second antenna including a second ground terminal, a second feed terminal, a second radiator, and a conductor pattern electrically connected to the second ground terminal; and a substrate configured to transmit a radio frequency (RF) signal for realizing coupling between the conductor pattern and the first radiator, wherein the first and second housings are configured to contain the first antenna carrier, the second antenna carrier, and the substrate so as to protect the first antenna carrier, the second antenna carrier, and the substrate from external shocks.

12. The electronic device of claim 11, wherein the first and second housings have a metal frame structure.

13. The electronic device of claim 11, further comprising:

a battery configured to supply power to the electronic device.

14. The electronic device of claim 11, wherein the first antenna further includes another radiator configured to resonate at least in a frequency band different from a frequency band of the first radiator.

* * * * *